US007704660B2

(12) United States Patent
Kashiwabara et al.

(10) Patent No.: US 7,704,660 B2
(45) Date of Patent: Apr. 27, 2010

(54) DEVELOPER FOR ELECTRONIC PRINTING, AND PROCESS FOR PRODUCING GLASS PLATE HAVING ELECTRIC CONDUCTOR PATTERN

(75) Inventors: Satoshi Kashiwabara, Chiyoda-ku (JP); Naoki Okahata, Chiyodo-ku (JP); Kazuo Sunahara, Chiyoda-ku (JP)

(73) Assignee: Asahi Glass Company, Limited, Tokyo (JP)

( * ) Notice: Subject to any disclaimer, the term of this patent is extended or adjusted under 35 U.S.C. 154(b) by 575 days.

(21) Appl. No.: 11/620,312

(22) Filed: Jan. 5, 2007

(65) Prior Publication Data

US 2007/0160922 A1 Jul. 12, 2007

(30) Foreign Application Priority Data

Jan. 10, 2006 (JP) ..... 2006-002438

(51) Int. Cl.
*G03G 9/00* (2006.01)

(52) U.S. Cl. ..... 430/108.2; 430/108.3; 430/111.4; 430/120.2; 430/124.12

(58) Field of Classification Search ..... 430/108.1, 430/108.3, 111.4, 120.2, 124.12
See application file for complete search history.

(56) References Cited

U.S. PATENT DOCUMENTS 5,988,068 A 11/1999 Van Ritter et al.
6,087,056 A 7/2000 Toyoshima et al.
6,150,062 A * 11/2000 Sugizaki et al. ..... 430/45.55
6,183,933 B1 * 2/2001 Ishikawa et al. ..... 430/256
2002/0050061 A1 * 5/2002 Komyoji et al. ..... 29/846

FOREIGN PATENT DOCUMENTS

EP 0 440 822 A1 8/1991

(Continued)

OTHER PUBLICATIONS

U.S. Appl. No. 12/324,985, filed Nov. 28, 2008, Okahata, et al.

(Continued)

*Primary Examiner*—Mark A Chapman
(74) *Attorney, Agent, or Firm*—Oblon, Spivak, McClelland, Maier & Neustadt, L.L.P.

(57) ABSTRACT

To provide a process for producing a glass plate having an electric conductor pattern excellent in adhesion to the surface of the glass plate, whereby it is not required to have a screen ready for every model and adjustment to desired electric heating performance and antenna performance is easy, and a developer therefor. A developer for electronic printing, characterized in that the ratio of $F_{tc}/F_{tp}$ is at least 2.5, where $F_{tc}$ is the adhesive force acting between one toner particle containing conductive fine particles and one carrier, and $F_{tp}$ is the adhesive force acting between one toner particle containing conductive fine particles and a photoconductor. A process for producing a glass plate is having an electric conductor pattern, which comprises a step of using such a developer for electronic printing and forming a pattern of a toner on a surface of a glass plate by an electronic printing system, and a step of heating the glass plate having the pattern of the toner formed on its surface, at a predetermined temperature to convert the pattern of the toner to a pattern of an electric conductor.

20 Claims, 2 Drawing Sheets

FOREIGN PATENT DOCUMENTS

| | | |
|---|---|---|
| JP | 2001-281920 | 10/2001 |
| JP | 2002-244337 | 8/2002 |

OTHER PUBLICATIONS

U.S. Appl. No. 12/327,140, filed Dec. 3, 2008, Okahata, et al.

U.S. Appl. No. 11/564,922, filed Nov. 30, 2006, Satoshi Kashiwabara, et al.

U.S. Appl. No. 11/617,219, filed Dec. 28, 2006, Satoshi Kashiwabara, et al.

U.S. Appl. No. 12/061,093, filed Apr. 2, 2008, Okahata, et al.

* cited by examiner

DEVELOPER FOR ELECTRONIC PRINTING, AND PROCESS FOR PRODUCING GLASS PLATE HAVING ELECTRIC CONDUCTOR PATTERN

The present invention relates to a developer for electronic printing, and a process for producing a glass plate having an electric conductor pattern. Particularly, it relates to a developer for electronic printing capable of forming a pattern of an electric conductor excellent in adhesion to the surface of a glass plate to be used for a window of an automobile or the like, in high quality with little contamination and a process for producing a glass plate having an electric conductor pattern.

In recent years, various methods have been proposed wherein a toner (ink) comprising conductive fine particles made of metal such as silver, and a thermoplastic resin, is printed on an inorganic substrate by an electronic printing method, followed by firing to form a conductive wiring pattern. However, as compared with a usual printing toner, an electronic printing toner contains a large amount of conductive fine particles and thus has a large specific gravity (at least 3.0 g/cm$^3$), and control of the electrification is difficult, whereby there is a problem such that an image quality defect (hereinafter referred to as contamination) caused by scattering of the toner to a non-image area, is likely to result. Especially when contamination takes place on a glass plate used for an automobile window, the contamination is distinctly observed when visual observation is done through the window, and accordingly, it is acutely desired to solve the problem of contamination.

In order to solve such contamination, it has been proposed to employ a conductive metal or metal oxide which is hollow or which has a plurality of fine pores thereby to reduce the apparent specific gravity of the toner (Patent Document 1). However, the contamination is substantially influenced by the adhesive force between the toner particles and can hardly be fundamentally solved solely by control of the shape of the toner or the weight such as specific gravity. On the other hand, for the purpose of improving the resolution, it is common to reduce the particle size of the toner, but there is a problem that as the particle size is reduced, control of the toner in the electric field tends to be difficult. Especially with a toner for electronic printing containing a large amount of conductive particles, control of the electrification tends to be difficult because of fluctuation in the distribution of particles, and thus it has been very difficult to solve the contamination by reducing the particle size of the toner.

A two component development system is designed to prevent contamination by an electrostatic force between a toner and a carrier or by a development electric field. However, in a toner containing a large amount of conductive particles, a toner not electrified (hereinafter referred to as a non-electrified toner) will be present. Such a non-electrified toner will receive no influence of the electrostatic force between the toner and the carrier or the development electric field, and there will be a problem that it will remain as contamination on an image carrier.

Patent Document 1: JP-A-2001-281920 (Claims)

It is an object of the present invention to provide a developer for electronic printing capable of forming a conductive pattern which is excellent in electrical conductivity and which is of high quality with little contamination, and a process for producing a glass plate with an electric conductor pattern, which is obtainable by using such a developer.

The present invention provides a developer for electronic printing as disclosed in the following (1) to (4) and a process for producing a glass plate having an electric conductor pattern as disclosed in the following (5) to (7).

(1) A developer for electronic printing, characterized in that the ratio of $F_{tc}/F_{tp}$ is at least 2.5, where $F_{tc}$ is the adhesive force acting between one toner particle containing conductive fine particles and one carrier, and $F_{tp}$ is the adhesive force acting between one toner particle containing conductive fine particles and a photoconductor.

(2) The developer for electronic printing according to (1), wherein $F_{tp}$ is at most 40 nN.

(3) The developer for electronic printing according to (1) or (2), wherein the adhesive force $F_{tt}$ acting between one toner particle containing conductive fine particles and another toner particle containing conductive fine particles, is at most 30 nN.

(4) The developer for electronic printing according to any one of (1) to (3), wherein the toner particles have an average particle diameter of from 10 to 35 μm.

(5) A process for producing a glass plate having an electric conductor pattern, which comprises a step of using a toner in the developer for electronic printing as defined in any one of (1) to (4) and forming a pattern of the toner on a surface of a glass plate by an electronic printing system, and a step of heating the glass plate having the pattern of the toner formed on its surface, at a predetermined temperature to convert the pattern of the toner to a pattern of an electric conductor.

(6) The process for producing a glass plate having an electric conductor pattern according to (5), wherein the temperature for heating the glass plate is from 600 to 740° C.

(7) The process for producing a glass plate having an electric conductor pattern according to (5) or (6), wherein at the same time as the glass plate is heated to convert the pattern of the toner to a pattern of an electric conductor, the heated glass plate is subjected to thermal processing.

According to the present invention, it is possible to form a conductive pattern of high image quality with little contamination on a glass plate surface in good adhesion. It is thereby possible to easily form on a glass plate surface a conductive pattern having the desired heat generation performance or antenna performance.

In the accompanying drawings.

REFERENCE NUMERALS

Figure 1:
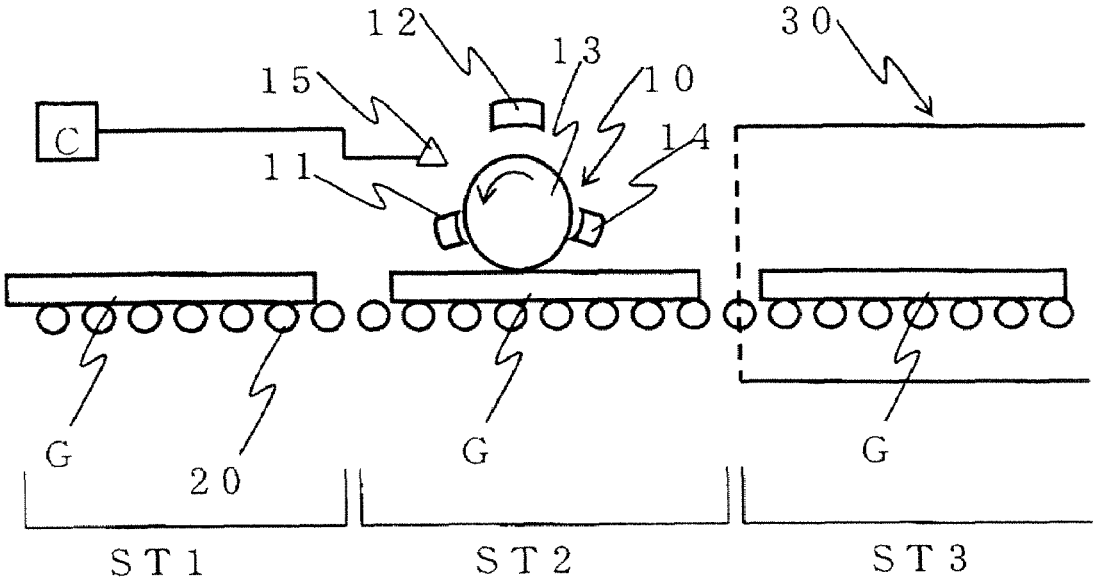
FIG. 1 is a schematic side view illustrating an example of a continuous process for producing a glass plate having an electric conductor pattern of the present invention.

| | |
|---|---|
| 1: | Defogger |
| 2: | Antenna wiring |
| 3: | Busbar |
| 4: | Dark colored ceramic fired product |
| 10: | Electronic printing apparatus |
| 11: | Developing device |
| 12: | Electrification device |
| 13: | Photoconductor drum |
| 14: | Static eliminator |
| 15: | Light source |
| 20: | Conveyor roll |
| 30: | Heating furnace |
| G: | Glass plate |
| C: | Computer |
| ST1: | Chamfering step |
| ST2: | Printing step |
| ST3: | Firing step |
| ST4: | Inspection step |

In the present invention, electronic printing means printing by a xerography system. The xerography system is basically such that an electrostatically charged photoconductor drum is exposed to form an electrostatic latent image, the latent image is developed by a toner to form a pattern of the toner on the photoconductor drum surface, and then this pattern of the toner is transferred from the photoconductor drum surface to the surface of a substrate (in the present invention, to the surface of a glass plate). The present invention is an invention of a developer suitable for such electronic printing. In this specification, the developer is meant for a mixture of a carrier and a toner.

When the toner contained in the developer of the present invention is, after printed on a substrate, heated to a predetermined temperature, the binder component in the toner starts to be decomposed or melted. When the temperature is further raised, the conductive fine particles will be sintered and bonded to one another, and the binder component is considered to fill spaces between the conductive fine particles thus sintered. It is considered that when the binder component is then cooled and solidified, an electric conductor comprising the bonded electroconductive fine particles and the binder component filling the spaces between the particles, will be produced. Thus, the pattern formed by the toner of the present invention is converted to a pattern of an electric conductor, when it is heated to the above predetermined temperature and then cooled. Heating to the temperature at which the binder component will be melted, will hereinafter be referred to also as firing, and the temperature therefor will be referred to also as the firing temperature. The present invention is an invention of a developer which is suitable for an application wherein a toner pattern formed by electronic printing is converted to a pattern of an electric conductor by firing.

The substrate on which a pattern of an electric conductor is formed by using the developer of the present invention, may be any substrate made of a material durable at the above-mentioned predetermined temperature. As the substrate in the present invention, a glass plate is preferred, and particularly preferred is a glass plate to be used for a window of an automobile. The present invention also provides a process for producing a glass plate having an electric conductor pattern, which comprises forming an electric conductor pattern on the surface of a glass plate by using such a developer.

Figure 3:
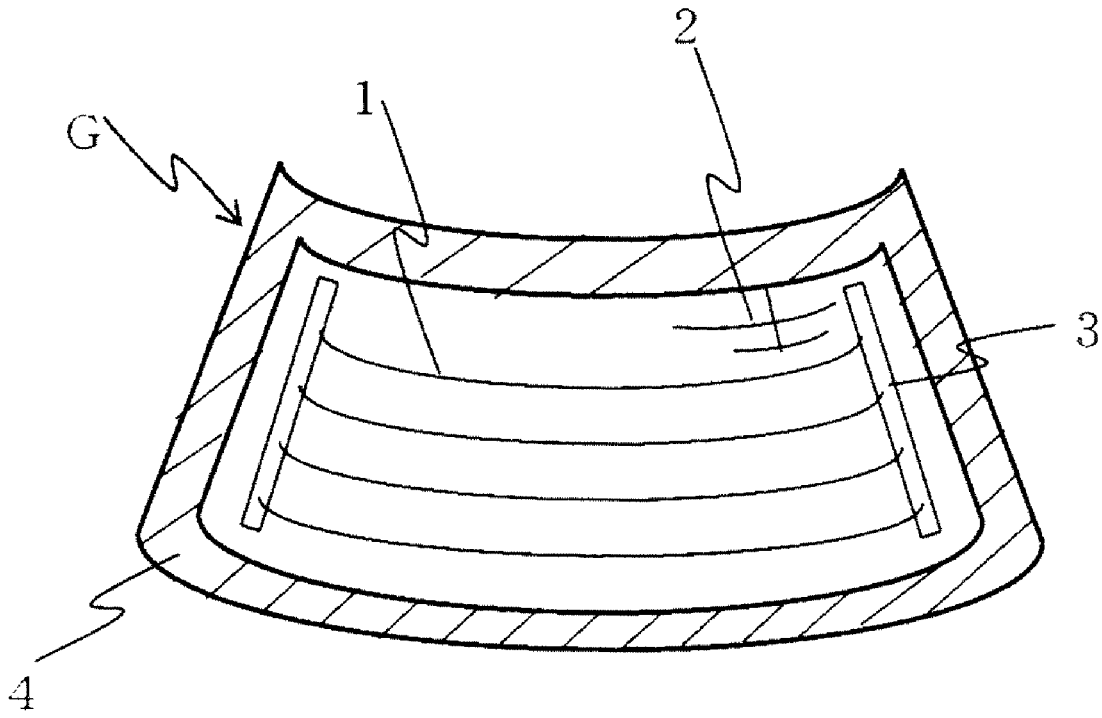
FIG. 3 is a front view illustrating an example of rear window of an automobile.

In the present invention, the electric conductor pattern may be a pattern made of a line-form conductor or a pattern made of a strip-form conductor, or a pattern made of a combination of a line-form conductor and a strip-form conductor. For example, as shown in FIG. 3, a defogger or an antenna is constituted by a pattern made of a line-form conductor, while a bus bar is constituted by a pattern made of a strip-form conductor.

Now, an embodiment of the present invention will be described with reference to the drawings.

FIG. 1 is a schematic side view illustrating an example of a continuous process for producing a glass plate having an electric conductor pattern of the present invention. The glass plate G is transported to a printing step via a step (ST1) of cutting into a predetermined shape, chamfering, cleaning, etc. In the printing step ST2, the toner contained in the developer is printed in a predetermined pattern on the glass plate G by an electronic printing apparatus 10. The glass plate G having the toner printed in a prescribed pattern is transported into a heating furnace 30. In the heating furnace 30, the glass plate G is heated to a predetermined temperature, and the toner is fired on the glass plate G and converted to an electric conductor, whereby a glass plate having a predetermined electric conductor pattern is prepared. The formed electric conductor pattern is transported to an inspection step (ST4, not shown) and inspection of the resistance value is carried out. The result of the inspection in the inspection step ST4 is transmitted to a computer C, whereupon after judgment whether or not the desired electric heating performance or antenna performance is obtainable, the judged information is converted to information for adjustment of the pattern such as the shape of the pattern or the wiring width, which is utilized for the control of the printing pattern in a printing step ST2.

In the step ST1, a rectangular glass plate is cut into a predetermined shape, and the cut surface is chamfered. Then, the glass plate is cleaned and, if necessary, preheated and transported to the printing step ST2 by conveyor rolls 20.

In the printing step ST2, a photoconductor drum 13 is subjected to removal of electricity by a static eliminator 14 while the photoconductor drum is rotated. Then, the photoconductor drum is charged by an electrification device 12 and irradiated with an exposure light from a light source 15 to have the photoconductor drum exposed with a predetermined pattern. Then, the exposed surface of the photoconductor drum 13 is rotated to a developing device 11, so that a toner is presented to the photoconductor drum, whereby a toner layer is formed in a predetermined pattern on the surface of the photoconductor drum 13. At that time, the toner is stirred and mixed with a carrier in the developing device, then transported via the carrier and presented to the photoconductor drum. The toner layer in the predetermined pattern on the surface of the photoconductor drum 13 will be transferred to the surface of a glass plate G transported by the rotation of the photoconductor drum 13. Thus, a toner layer of a predetermined pattern is formed on the surface of the glass plate G. At that time, a secondary transfer plate such as an intermediate transfer belt may be interposed between the photoconductor drum 13 and the surface of the glass plate G. In a case where such an intermediate transfer belt is interposed, the intermediate transfer belt may be supported from inside, and transfer may be carried out by a thermal transfer roll not shown, which is disposed to press the glass plate G.

In the computer C, the pattern information to have exposure light irradiated to carry out exposure in a predetermined pattern, is stored. Accordingly, by a direction from the computer C, an exposure light from the light source 15 is irradiated in a predetermined pattern. In a case where the glass plate G is to be used for a window of an automobile, the shape of the glass plate, the shape of the electric conductor pattern, etc. vary depending upon the type of the automobile. Accordingly, on the basis of such data corresponding to the type of the automobile, the instruction signal may be changed, and it is thereby possible to easily change from the production of a glass plate of a certain type to the production of a glass plate of another type.

The glass plate G having a toner layer of a predetermined pattern, is transported into a heating furnace 30 and heated at a predetermined temperature, usually from about 600 to 740° C. The toner is thereby fired on the surface of the glass plate G, whereby an electric conductor of a predetermined pattern is formed on the glass plate. Usually, a glass plate for a window of an automobile is curved. Accordingly, when the glass plate having an electric conductor pattern prepared as described above, is to be used for a window of an automobile, it is heated in the firing step ST3 and subjected to reinforcing treatment via bending processing. Here, there may be a case where instead of reinforcing treatment, annealing treatment may be carried out (bending of the glass plate for laminated glass). Further, the temperature for the thermal processing of the glass plate will hereinafter be referred to as a thermal processing temperature.

The lower limit of the above-mentioned firing temperature is the lowest temperature at which decomposition or melting of the binder resin takes place (preferably sintering of the conductive fine particles also takes place), and the upper limit of the firing temperature is usually whichever is lower the temperature at which the conductive fine particles melt or the temperature at which the binder resin completely disappears. The temperature for the above-mentioned thermal processing is usually a temperature of at least such a lower limit of the firing temperature. Accordingly, by heating the glass plate to such a thermal processing temperature, firing of the toner will take place during the heating process.

When the toner is fired, a composition comprising the conductive fine particles and the decomposition product or melt of the binder component, will be formed. Further, it is preferred that the conductive fine particles will be in a sintered state (i.e. the fine particles will be in a state of being bonded to one another while maintaining the fine particle shape). In such a case, the decomposed or molten binder component is considered to fill spaces between the sintered conductive fine particles. Further, it is conceivable that the conductive fine particles will form an electric conductor without being sintered. In such a case, it is considered that the conductive fine particles maintain the mutually contacted state, and molten binder component will fill the spaces between the conductive fine particles to bond the conductive fine particles one another. Thereafter, the glass plate is cooled, whereby molten binder component will be solidified, and it will be possible to obtain an electric conductor comprising the electroconductive fine particles and solidified binder component.

The developer for electronic printing of the present invention (hereinafter referred to as the present developer) is characterized in that the ratio of $F_{tc}/F_{tp}$ is at least 2.5, where $F_{tc}$ is the adhesive force acting between one toner particle containing conductive fine particles and one carrier, and $F_{tp}$ is the adhesive force acting between one toner particle containing conductive fine particles and a photoconductor (corresponding to the photoconductive drum). When this $F_{tc}/F_{tp}$ is at least 2.5, even if after being supplied from the developing device 11, toner particles scattered to a non-image portion fall on the photoconductor drum 13, they are likely to be recovered by the carrier, whereby it is possible to prevent formation of a printing defect such as contamination. More preferably, $F_{tc}/F_{tp}$ is at least 3.0.

Here, in this specification, the adhesive force is meant for a non-electrostatic adhesive force. Such a non-electrostatic adhesive force correspond to the sum of the van der Waals' force and the liquid bridge force. The adhesive force can be optionally adjusted mainly by selecting the material, etc. constituting the developer, as described below. Otherwise, $F_{tp}$ may be made small by imparting fine irregularities to the surface of the photoconductor drum 13.

Next, in the present developer, $F_{tp}$ is preferably at most 40 nN. When $F_{tp}$ is at most 40 nN, it is possible to prevent the toner particles from remaining on the photoconductor drum 13 after the transfer, and it is possible to prevent scumming of the photoconductor drum 13, whereby formation of contamination can further be prevented. More preferably, $F_{tp}$ is at most 35 nN.

Further, in the present developer, the adhesive force $F_{tt}$ acting between one toner particle containing conductive fine particles and another tone particle containing conductive fine particles, is preferably at most 30 nN. When $F_{tt}$ is at most 30 nN, the dispersibility of the toner particles in the developer will be improved, and the frictional electrification will be facilitated, whereby formation of contamination can be prevented more easily. More preferably $F_{tt}$ is at most 27 nN.

In the present developer, the material for the carrier is not particularly limited, and a ferrite carrier coated with a silicone resin or an acryl resin may, for example, be preferably employed. It is particularly preferred to employ a carrier coated with a resin having a high affinity with the resin in the toner particles, whereby the van der Waals' force acting between one toner particle and one carrier will be large, and $F_{tc}$ can be made large. Further, the particle size of the carrier is not particularly limited, but it is preferably from 20 to 120 μm. If the carrier particle size exceeds 120 μm, the development tends to be rough. On the other hand, it tends to remain on the photoconductor. The van der Waals' force tends to be is large as the particle size becomes large, and it is particularly preferred that the particle size of the carrier is at least 20 μm, whereby the van der Waals' force acting between toner particles will be large, and $F_{tc}$ can be made large. Further, the blend ratio of the toner (T) to the carrier (C) in the present developer (hereinafter referred to also as the T/C ratio) is preferably from 2 to 15 wt %. When the T/C ratio is at least 2 wt %, fading of an image tends to scarcely result. On the other hand, when the T/C ratio is made to be at most 15 wt %, frictional electrification between the carrier and the toner, will be sufficiently carried out, whereby insufficiently electrified toner particles can be minimized. More preferably, the T/C ratio is within a range of from 3 to 8 wt %.

The toner in the present developer (hereinafter referred to as the present toner) preferably comprises conductive fine particles, a heat decomposable binder resin (hereinafter referred to as the present binder resin) and glass frit. In such a case, the heat decomposable binder resin is a component which functions as a binder to bond a conductive fine particle and glass frit as one matrix particle, or which functions as a binder to transfer the toner pattern on e.g. a photoconductor drum to the substrate and to fix the conductive fine particles and glass frit on the substrate until the glass frit will melt.

In the heating process after the pattern of the present toner is formed on the glass plate, firstly, the present binder resin in the present toner will be decomposed. The decomposed present binder resin will be vaporized and will disappear from the glass plate by heating. After majority of the present binder resin has been vaporized, the glass frit begins to be melted, and the conductive fine particles in the present toner will be fixed on the glass plate surface mainly by the adhesive property of the glass frit. In such a process, the present binder resin is completely decomposed and evaporated during the period until the glass frit is completely melted, whereby the amount of the resin remaining in the electric conductor after the firing can be reduced. Finally, the glass plate is heated to a temperature exceeding 600° C., whereby the conductive fine particles will be sintered to form an electric conductor.

It is preferred that the lower limit of the firing temperature is almost the same as or higher temperature than the melting temperature Ts of the glass frit, and $T_{100}$ of the present binder resin (the temperature at which disappearance of the present binder resin substantially takes places) is almost the same or lower temperature than Ts. On the basis of such Ts, if $T_{100}$ of the present binder resin is too high as compared with Ts, a decomposed product of the present binder resin remains in the conductor. Further, if $T_{100}$ of the present binder resin is too low as compared with Ts, the present binder resin is completely decomposed before melting of the glass frit takes place, whereby the conductor is unlikely to be sufficiently fixed on the surface of the glass plate. Accordingly, it is preferred that, as the present binder resin, a resin having an appropriate $T_{100}$ is selected in accordance with Ts of the glass frit.

Further, $(T_{100}-T_{90})$ of the present binder resin is preferably from 0.1 to 15° C. When $(T_{100}-T_{90})$ is at least 0.1° C., a small amount of the present binder resin is remaining even at the time when the glass frit starts to be melted, near Ts, the electric conductor can be better fixed to the glass plate surface by the adhesive property of both the resin and the glass frit, and it is thereby possible to increase the adhesion of the electric conductor to the glass plate surface. On the other hand, when $(T_{100}-T_{90})$ is at most 15° C., the present binder resin can be sufficiently decomposed before the glass frit is completely melted, whereby the present binder resin will scarcely remain as a char in the electric conductor, and sintering failure of the conductive fine particles to one another will scarcely result. $(T_{100}-T_{90})$ is particularly preferably from 5 to 15° C.

Here, the above $T_{100}$ is a temperature at the time when a weight change has become no longer observed during a temperature rise from room temperature at a rate of 10° C./min by means of a thermogravimetric analyzer (TG). Further, the above $T_{90}$ is a temperature at the time when weight reduction of the present binder resin has become 90 wt % during a temperature rise from room temperature at a rate of 10° C./min by means of a thermogravimetric analyzer (TG).

The conductive fine particles may, for example, be metal fine particles or conductive oxide fine particles. As the metal fine particles, fine particles of gold, platinum, silver or copper are preferred. As the conductive oxide fine particles, fine particles of ITO (indium-doped tin oxide) or ATO (antimony-doped tin oxide) are preferred. In a case where the glass plate having a pattern of a line-form conductor formed is to be used for a window of an automobile, the width of the conductor can not be made so large, since it is necessary to ensure that the formed pattern of the conductor will not block the eyesight. Accordingly, it is particularly preferred to select fine particles of silver as the conductive fine particles in order to obtain a desired resistance value with a narrow wiring width.

The content of the conductive fine particles is preferably from 59.8 to 83.8 parts by mass per 100 parts by mass of the total solid content of the present toner particles. When the content of the conductive fine particles is at least 59.8 parts by mass, the electrical conductivity of the electric conductor can sufficiently be maintained, and the volume shrinkage of the electric conductor formed by firing at the time of cooling can be suppressed, whereby its peeling from the glass plate surface or cracking can be prevented. Further, when it is at most 83.8 parts by mass, constant electrification can be attained as a toner. Further, it is possible to reduce the exposed area of the conductive fine particles occupying the surface of the present toner particles and to reduce the liquid bridge force acting between one particle of the present toner and one carrier, whereby $F_{tp}$ can be made to be small. The content of the conductive fine particles is particularly preferably from 69.8 to 80.8 parts by mass.

The conductive fine particles preferably have an average particle diameter of from 0.2 to 20 μm. When the average particle diameter is at least 0.2 μm, the volume shrinkage of the obtainable electric conductor will be suppressed, and its peeling from the glass plate surface can be prevented. On the other hand, when the average particle diameter is at most 20 μm, the print quality of the obtainable conductive printed wiring can be made high. The conductive fine particles particularly preferably have an average particle diameter of from 0.5 to 10 μm. In this specification, the average particle diameter of the particles is meant for the average diameter based on the number of particles. The average particle diameter can be measured by a conventional method, and, for example, can be measured by using a particle size distribution meter of e.g. a flow system, a laser diffraction/scattering system or a dynamic light scattering system.

Among them, it is particularly preferred to use a flow system particle size distribution meter, since it is thereby possible to accurately measure even a low frequency particle size distribution, or to measure the shape of particles at the same time as the average particle diameter.

As the glass frit, any glass frit may be used irrespective of lead-type or non-lead-type. However, from the viewpoint of environment, etc., a bismuth-silica glass frit of non-lead-type is preferred. The melting temperature Ts of the glass frit is preferably from 400 to 550° C., particularly preferably from 450 to 500° C. When the melting temperature Ts of the glass frit is from 400° C. to 550° C., it is possible to easily select the binder resin with $T_{100}$ satisfying the relation between the above Ts and $T_{100}$ of the present binder resin, and particularly when the melting temperature Ts of the glass frit is from 450° C. to 550° C., it is possible to easily use a binder resin with good decomposition properties. Further, if Ts of the glass frit exceeds 550° C., such a temperature is too close to 600° C. which is the lower limit of the usual processing temperature of the glass plate, whereby the glass frit is unlikely to melt sufficiently at the time of thermal processing of the is glass plate.

The present binder resin is a heat decomposable resin having the above-mentioned functions, and the type of the resin is not limited so long as it has the appropriate heat decomposition temperature and functions as a binder. However, the present binder resin is preferably a heat decomposable resin having functional groups, in order to provide functions such that the toner is unlikely to aggregate before it is supplied to the photoconductor drum; the toner adheres to the photoconductor drum by an appropriate adhesiveness ($F_{tp}$); the toner pattern on the photosensitive drum can be properly transferred to the substrate; and further, the fixing property of the toner pattern transferred to the substrate is good. Further, such functional groups are preferably acidic groups such as carboxyl groups.

The present binder resin is preferably a heat decomposable resin containing, as the main component, an acid-modified thermoplastic resin having an acid value of at least 5, whereby the fixing property to the glass plate surface is excellent and the decomposition property during the heat treatment is also excellent. Here, the acid value is the number of mg of potassium hydroxide which is required to neutralize the acidic groups which are present in 1 g of a resin. The reason for the excellent fixing property by employing the heat decomposable resin containing, as a main component, an acid-modified thermoplastic resin having an acid value of at least 5, is not clearly understood, but it is considered to be attributable to an interaction between the acidic groups in the binder resin and silanol groups at the surface of the glass plate. Here, the present binder resin may be made solely of the acid-modified thermoplastic resin, or a combination of the acid-modified thermoplastic resin with other heat decomposable resins (for example, a thermoplastic resin having no acidic groups). In the latter case, it is preferred that the proportion of the heat decomposable resins other than the acid-modified thermoplastic resin is relatively small to the acid-modified thermoplastic resin, and the proportion is preferably at most 30 mass %, particularly preferably at most 10 mass %, based on the total resin amount of the present binder resin. It is preferred that both of the polymer in the main chain in the acid-modified thermoplastic resin and the polymer of the main chain in other heat decomposable resins are polymers obtainable by vinyl polymerization. Types of both main skeletons may be the same or different. Even in the case of containing other heat decomposable resins, it is preferred that the acid value of the present binder resin is at least 5, and the acid value of the entire resin containing such other heat decomposable resin having no acidic groups is at least 5. Further, as the acid-modified thermoplastic resin or other heat decomposable resins in the present binder resin, it is possible to use commercial products.

The acid value of the present binder resin is preferably from 5 to 100, more preferably from 20 to 100. It is thereby possible to form a pattern excellent in the fixing property when the present toner is electro-printed on a glass plate surface. When the acid value is at least 5, particularly at least 20, the number of acidic groups can be secured, whereby the fixing property of the pattern will be stabilized and, adhesion failure of the electric conductor after the firing will scarcely result. On the other hand, when the acid value is at most 100, the melt viscosity of the present binder resin will not be too high, and the present toner can be sufficiently fixed to the substrate surface by electronic printing, and further, a failure such as offset on a thermal transfer roll not shown will scarcely result. The acid value is more preferably from 30 to 70.

The acid-modified thermoplastic resin is a polymer having acidic groups, and the acidic groups in the present invention are carboxyl groups or carboxylic anhydride groups. The acid-modified thermoplastic resin is a thermoplastic resin having either or both of the carboxyl groups and the carboxylic anhydride groups. The acid-modified thermoplastic resin is preferably a polymer obtainable by copolymerizing a monomer having an acidic group or a polymer obtainable by reacting a compound is having an acidic group with a thermoplastic resin. Further, it is also possible to obtain a polymer containing acidic groups by hydrolysis of a polymer obtained by copolymerizing an unsaturated carboxylate monomer. The acid-modified thermoplastic resin in the present invention is particularly preferably an acid-modified thermoplastic resin obtainable by reacting a compound having an acidic group with a thermoplastic resin previously produced.

The main monomer constituting the acid-modified thermoplastic resin may, for example, be an olefin, an aromatic vinyl monomer such as styrene, a (meth)acrylate monomer such as an acrylate or a methacrylate, an unsaturated alcohol ester monomer such as vinyl acetate, or a diene monomer such as butadiene. Particularly preferred is a thermoplastic resin obtainable from an olefin having at most 6 carbon atoms such as ethylene or propylene as the main monomer.

The compound having an acidic group (hereinafter referred to as an acid-modifying agent) is preferably an unsaturated carboxylic acid or an unsaturated polycarboxylic anhydride. It is particularly preferably an unsaturated dicarboxylic acid or an unsaturated dicarboxylic anhydride. Specifically, acrylic acid, methacrylic acid, maleic acid, fumaric acid, itaconic acid, citraconic acid, maleic anhydride, itaconic anhydride or citraconic anhydride may, for example, be mentioned. The acid-modifying agent is particularly preferably maleic anhydride. Accordingly, the acid-modified thermoplastic resin is preferably an acid-modified thermoplastic resin obtainable by reacting an unsaturated carboxylic acid or an unsaturated carboxylic anhydride with a thermoplastic resin, particularly preferably a maleic anhydride-modified thermoplastic resin.

The acid-modified thermoplastic resin is preferably an acid-modified polyolefin obtainable by reacting a compound having acidic groups with a polyolefin. The polyolefin may, for example, be a polyethylene, polypropylene or an ethylene-propylene copolymer, and among them, polypropylene is preferred since constant electrification can thereby be easily secured as a toner. The method of reacting an acid-modifying agent with a polyolefin, may, for example, be a method wherein the acid-modifying agent and a radical generator (such as a peroxide) are mixed in a polyolefin, followed by heating to react them, or a method wherein the acid-modifying agent is mixed and reacted to a low-molecular-weight polyolefin (having reaction sites such as unsaturated groups) obtainable by previously subjecting a polyolefin to partial heat decomposition. As the acid-modified polyolefin, it is preferred to employ a maleic anhydride-modified polyolefin, particularly a maleic anhydride-modified polypropylene, obtainable by means of such a method, from the viewpoint of the degree of electrification, the rising speed of the electrification and the stability of the electric charge. Further, the weight average molecular weight of the acid-modified polyolefin is not particularly limited, but is preferably from 3,000 to 150,000, particularly preferably from 5,000 to 80,000.

With regard to the heat decomposition property of the present binder resin, it is preferred to have an appropriate $T_{100}$ depending upon the melting temperature Ts of the glass frit as mentioned above. Accordingly, it is preferred that a heat decomposable resin having an appropriate $T_{100}$ is selected depending upon the value of Ts of glass frit to be used. The difference ($Ts-T_{100}$) between the melting temperature Ts of the glass frit and $T_{100}$ of the above present binder resin is preferably from 0 to 20° C. When ($Ts-T_{100}$) is from 0 to 20° C., it is possible to initiate melting of the glass frit before the present binder resin is completely decomposed and volatilized, and it is possible to increase the adhesion of the electric conductor to the glass plate surface. In addition to the above, the difference ($Ts-T_{90}$) between the Ts and $T_{90}$ of the present binder resin is preferably from 0 to 80° C. When ($Ts-T_{90}$) is at least 0° C., a small amount of the present binder resin still remains even at the time when the glass frit starts to be melted, near Ts, the electric conductor can be fixed to the glass plate surface by the adhesive property of both the present binder resin and the glass frit. Thus, the electric conductor is believed to be sufficiently adhered to the glass plate surface. On the other hand, when ($Ts-T_{90}$) is at most 80° C., the present binder resin can be sufficiently decomposed before the glass frit is completely melted, whereby it is considered that the present binder resin tends to scarcely remain as a char in the electric conductor, sintering failure of the conductive fine particles to one another tends to hardly result, and the adhesion of the electric conductor to the glass plate surface can be made high. ($Ts-T_{90}$) is more preferably from 0.1 to 50° C.

As mentioned below, the melting temperature Ts of the glass frit is preferably from 450 to 500° C. In such a case, $T_{100}$ of the present binder resin is preferably from 420 to 450° C. In such as case, when $T_{100}$ is at least 420° C., it is possible to prevent complete decomposition of the present binder resin before melting of the glass frit, and it is possible to sufficiently fix the electric conductor to the glass plate surface. On the other hand, when $T_{100}$ is at most 450° C., at the time of firing the toner, the present binder resin will be readily decomposed and volatilized, whereby it will scarcely remain as a residual carbon in the electric conductor, and an electric conductor excellent in the electrical conductivity can be obtained without blocking the sintering of the conductive fine particles to one another, and further, it is possible to obtain an electric conductor excellent in adhesion to the glass plate surface.

The content of the present binder resin is preferably from 5 to 40 parts by mass, based on 100 parts by mass of the total solid content of the present toner particles. When the content is at least 5 parts by mass, in a case where the present toner is electro-printed, its fixing property to the substrate can adequately be secured. Further, it is possible to reduce the exposed area of conductive fine particles occupying the surface of the present toner particles, and to reduce the liquid bridge force acting between one particle of the present toner and one carrier, whereby $F_{tp}$ can be made to be small. When the content is at most 40 parts by mass, the present binder resin tends to scarcely remain in the electric conductor after the firing, whereby defects such as cracks or voids tend to scarcely result in the electric conductor. The content of the present binder resin is particularly preferably from 10 to 30 parts by mass.

Further, the content of the glass frit is preferably from 0.2 to 5 parts by mass based on 100 parts by mass of the total solid content of the present toner particles. When the content of the glass frit is at least 0.2 part by mass, it is possible to secure the adhesion of the electric conductor to the substrate surface, and on the other hand, when the content is at most 5 parts by mass, it is possible to suppress an increase of the resistivity of the electric conductor pattern by an increase of the amount of the glass frit component relative to the conductive fine particles. Further, the glass frit is preferably a powder having an average particles diameter of from 0.1 to 5 μm. When the average particle diameter of the glass frit is at least 0.1 μm, its adhesion to the substrate surface can sufficiently be secured, and when the average particle diameter is at most 5 μm, it is possible to prevent exposure of the glass frit on the surface of the particles of the present toner, and the fixing property tends to scarcely decrease when the toner is printed on the substrate surface by an electronic printing method. The glass frit particularly preferably has an average particle diameter of from 0.5 to 3 μm.

To the present toner particles in the present developer, an inorganic pigment such as black iron oxide, cobalt blue or iron oxide red, an azo-type metal-containing dye, a salicylic acid-type metal-containing dye, or a charge-controlling agent such as a quaternary ammonium salt may, for example, be incorporated as the case requires, in addition to the above-described components.

The present toner is produced, for example, by mixing the present binder resin, the conductive fine particles and the glass frit, etc., followed by kneading and cooling to prepare pellets, which are then pulverized and classified. At that time, the heating temperature is preferably from 150 to 200° C. When the heating temperature is at least 150° C., mixing of the present binder resin, the conductive fine particles and the glass frit, etc. can be carried out uniformly. On the other hand, when the heating temperature is at most 200° C., decomposition of the present binder resin can be prevented. In the present developer, the average particle diameter of the present toner particles is preferably from 10 to 35 μm. When the average particle diameter is at least 10 μm, the conductive fine particles in the present toner are prevented from being exposed on the surface, and the electrification of the present toner can be secured, whereby during the electronic printing, it is possible to avoid a pattern defect such as contamination due to inadequate electrification of the present toner. On the other hand, when the average particle diameter is at most 35 μm, a highly precise printing quality can be readily obtainable. It is particularly preferred to have the average particle diameter of the present toner particles adjusted to be at least 15 μm, whereby the van der Waals' force acting between one particle of the present toner and one carrier becomes large, and $F_{tc}$ can be made to be large.

Further, the shape of the present toner particles is preferably spherical, whereby the contact area of toner particles one another can be reduced and the van der Waals' force acting between toner particles can be made to be small, and consequently a developer having small $F_{tt}$ can be easily be obtained.

Further, fine particulate material (hereinafter referred to as an external additive) may be dispersively adhered to the surface of the present toner particles. By such dispersive adhesion on the surface of the present toner particles, the external additive has a function to increase the flowability of the present toner in e.g. a developing device 11 without impairing the transfer ratio from e.g. the photoconductor drum 13 to the glass plate surface. Further, the exposed area of conductive fine particles occupying the surface of the present toner particles can be reduced, and the liquid bridge force acting between one particle of the present toner and one carrier can be reduce, whereby $F_{tp}$ can be made to be small. The type of the external additive is not particularly limited, and inorganic fine particles made of e.g. silica or titanium oxide, or heat decomposable organic resin fine particles, may, for example, be preferably employed. It is particularly preferred to use heat decomposable organic resin fine particles as the external additive, since it is thereby possible to control the electrification distribution of the present toner. As such as organic resin, it is preferred to employ a thermoplastic resin which is readily decomposed and volatilized by heating, and such a resin may, for example, be at least one member selected from the group consisting of polyethylene, polypropylene, polystyrene, an acrylic resin and a styrene/acrylate copolymer resin. Particularly preferred is an acrylic resin and/or a styrene/acrylate copolymer resin, whereby the electrification characteristics of the present toner will be excellent.

The particle diameter of the external additive is preferably from 10 to 800 nm. When the particle diameter is at least 10 nm, the flowability of the present toner can be improved, whereby it is readily possible to obtain an effect to improve the transfer ratio and the image quality. On the other hand, when this particle diameter is at most 800 nm, the external additive will be uniformly dispersed on the surface of the present toner particles, whereby the flowability of the present toner can be improved. At that time, it is particularly preferred to bring the ratio of the particle diameter of the external additive to the particle diameter of the present toner particles to be within a range of [particle diameter of the external additive]/[particle diameter of the present toner particles] =0.003 to 0.05, whereby the effect of improving the flowability of the present toner can readily be obtained.

The content of the external additive is preferably from 0.1 to 5 parts by mass, per 100 parts by mass of the present toner particles. When the content is at least 0.1 part by mass, the effect of improving the flowability of the present toner and improving the transfer ratio and the image quality can readily be obtained. On the other hand, when the content of the external additive is at most 5 parts by mass, it is possible to prevent deterioration of the fixing property between the present toner particles and the glass plate surface. The content of the external additive is particularly preferably from 1 to 3 parts by mass per 100 parts by mass of the present toner particles. The external additive may be adhered to the present toner particles by means of a particle-complexing apparatus represented by HYBRIDIZATION SYSTEM (manufactured by NARA MACHINERY, CO., LTD.) or a mixer such as Henschel mixer or path mixer.

By using the present toner in the present developer obtained as described above, a pattern of the present toner is formed on a substrate surface by electronic printing and then fired to form an electric conductor. In a case where the substrate is a glass plate, the firing temperature is preferably from 600 to 740° C. When the firing temperature is at least 600° C., the conductive fine particles will be sufficiently sintered to one another. On the other hand, when the firing temperature is at most 740° C., deformation of the glass plate can be avoided. In the present invention, as the glass plate, soda lime glass, alkali-free glass or quartz glass may, for example, be used.

The electric conductor formed by the present invention, preferably has a resistivity of at most 20 μΩ·cm, whereby it can be used as an electric conductor for various applications such as wirings. Further, the thickness of the electric conductor is preferably from 5 to 30 μm. When the thickness is at least 5 μm, a constant resistivity can be readily obtained, and when the thickness is at most 30 μm, the desired thickness tends to be readily obtainable even by a single electronic printing operation, and thus the handling efficiency will be excellent.

Figure 2:
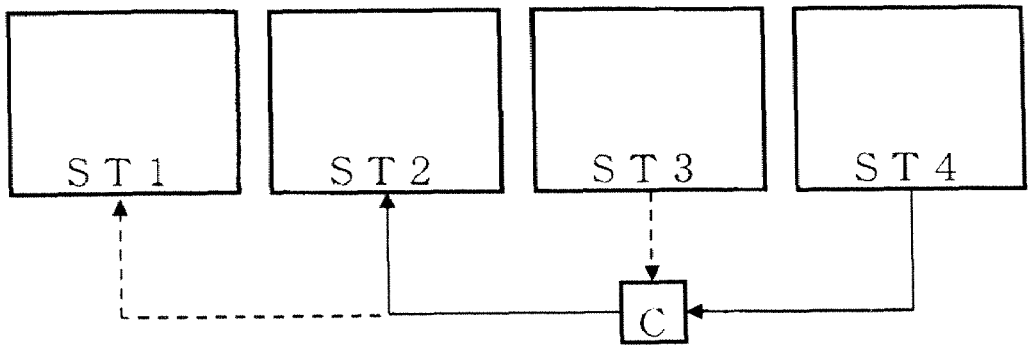
FIG. 2 is a schematic view illustrating a control process relating to a preferred embodiment of the present invention.

FIG. 2 is a schematic view illustrating a control process relating to a preferred embodiment of the present invention. On a glass plate pre-treated in ST1, a toner is printed in a predetermined pattern in the printing step ST2, and in the firing step ST3, the toner is fired by heating to obtain a glass plate with an electric conductor. In the inspection step ST4 after the firing step ST3, the resistance value of the electric conductor is measured. The data of the measured resistance value are sent to a computer C for controlling the pattern of the toner in the printing step. If necessary, the temperature data in the firing step ST3 are also sent to the computer C. The data sent to the computer C are utilized as data to judge whether or not the desired electro heating performance or antenna performance is obtained. If it is judged that the desired performance is not obtained, by calculation by the computer C, the line width of the toner to be printed or the printing pattern itself is adjusted so as to obtain the desired performance. The adjusted line width of the toner or printing pattern is fed back to the printing step ST2 to form the next electric conductor on the glass plate.

If a desired electro heating performance or antenna performance can be obtained by such feeding back, it is possible to produce a glass plate with an electric conductor in a large quantity by fixing the control data.

Further, in a case where the glass plate G is used for a window of an automobile, the computer C may be used to store the data of the shapes of glass plates depending upon the types of automobiles and the data of the patterns of the electric conductor, so that in the production of a glass plate for a certain type, an order based on the data relating to the shape of the pattern of a conductive printed wiring corresponding to that type may be transmitted to the electric printer, whereby a change from one type to another can easily be carried out, and printing depending on each type can be carried out. Further, an order based on the data of the shape of a glass plate among data relating to various types, may be transmitted to the cutting and chamfering step (ST1) for a glass plate, whereby a change from one type to another is can easily be carried out, and cutting and chamfering depending on each type can be carried out.

For example, on a rear window of an automobile illustrated in FIG. 3, conductive printed wirings (defoggers 1, antenna wires 2 and bus bars 3) are provided at the center region of the glass plate G, and a dark colored ceramic fired product 4 is provided at the peripheral region. By using the developer for electronic printing of the present invention, it is possible to have the above-mentioned conductive printed wirings printed on the glass plate surface.

EXAMPLES

Now, Examples 1 and 2 (Examples of the present invention) and Example 3 (Comparative Example) will be presented. Here, in Examples 1 to 3, with respect to the decomposition temperature, using a thermogravimetric analyzer (model: DTG-50, manufactured by Shimadzu Corporation), the measurement was carried out from room temperature to 700° C. at a temperature raising rate of 10° C./min, whereby the temperature $T_{100}$ at which a weight change of the resin disappears and the temperature $T_{90}$ at the time when the weight reduction of the resin has become 90%, were obtained. The average particle diameter of particles is a value with which the cumulative frequency becomes 50% in a cumulative particle size distribution curve based on the number of particles corresponding to circular diameters measured by using a flow particle image analyzer (tradename: FPIA-3000, manufactured by Sysmex Corporation).

Further, the average molecular weights of the resins used in Examples 1 to 3 are weight average molecular weights.

Example 1

20 Parts by mass of maleic anhydride-modified polypropylene (manufactured by Sanyo Chemical, tradename: YUMEX 1010, average molecular weight: 30,000, acid value: 52, $T_{100}$=430° C., $T_{90}$=420° C.), 79 parts by mass of silver powder (average particle diameter: 2 μm) and 1 part by mass of glass frit (bismuth-silica non-lead glass frit, melting temperature Ts: 450° C., average particle diameter: 2 μm) were mixed, kneaded at 170° C. using a kneader, and then cooled to room temperature to obtain a solid product. This solid product was pulverized by a jet mill and classified to obtain toner particles having an average particle diameter of 20 μm.

To 5 parts by mass of the toner particles thus obtained, 95 parts by mass of a carrier (manufactured by Powerdertech Co., Ltd., tradename: EF-80-47, average particle diameter: 80 nm) made of iron oxide coated with an acrylic resin was mixed to obtain a developer having a T/C ratio of 5.3 mass %.

Using such a developer, a thin line having a line width of 1 mm and a length of 80 mm was printed on a glass plate (length: 30 cm, width 30 cm, thickness: 3.5 mm) made of soda lime glass, by using an electronic printing machine (manufactured by Mitsubishi Heavy Industries, Ltd.), and then firing was carried out at 700° C. for 4 minutes to form a conductive wiring.

With respect to the obtained developer and conductive printed wiring, the following evaluations were carried out. The evaluation results are shown in Table 1. Also in the following Examples 2 and 3, evaluations were carried out in the same manner.

Evaluation of Adhesive Force

Using an inter-microparticle adhesive force-measuring device (manufactured by OKADA SEIKO CO., LTD., tradename: Contactore PAF-300N), the toner/carrier adhesive force ($F_{tc}$), the toner/photoconductor adhesive force ($F_{tp}$) and the toner/toner adhesive force ($F_{tt}$) were measured.

Evaluation of Contamination Particles

A glass plate obtained by printing and firing, was observed by an optical microscope. Taking a visual field of 3 mm×3 mm as a photographing region unit, ten photographing regions were visually selected on the glass plate surface. Observation of each selected photographing region unit was carried out, whereby the total number of the contamination particles was counted. Then, an average value of the number of contamination particles per unit area was taken as the number of contamination particles.

Example 2

To 99 parts by mass of the toner particles obtained in Example 1, 1 part by mass of spherical fine particles (manufactured by Soken Chemical & Engineering Co., Ltd., tradename: MP-300, average particle diameter: 100 nm, $T_{100}$=370° C.) made of an acrylic resin were added as heat decomposable organic resin fine particles, and the spherical fine particles made of the acrylic resin were attached to the toner particles by using HYBRIDIZATION SYSTEM (manufactured by NARA MACHINERY, CO., LTD.) to obtain toner particles. Except for using such toner particles, the operation was carried out in the same manner as in Example 1 to obtain a developer.

Example 3

Comparative Example

A developer was obtained in the same manner as in Example 1 except that the maleic anhydride-modified polypropylene was used in an amount of 15 parts by mass, the silver powder was used in an amount of 84 parts by mass.

TABLE 1

| | Toner/carrier adhesive force ($F_{tc}$) | Toner/Photo-conductor adhesive force ($F_{tp}$) | $F_{tc}/F_{tp}$ | Toner/toner adhesive force ($F_{tt}$) | Number of contamination particles (number/cm$^2$) |
|---|---|---|---|---|---|
| Ex. 1 | 143 nN | 31 nN | 4.6 | 26 nN | 3.1 nN |
| Ex. 2 | 56 nN | 20 nN | 3.1 | 18 nN | 2.3 nN |
| Ex. 3 | 121 nN | 43 nN | 2.1 | 58 nN | 43.2 nN |

From the results in Table 1, it is evident that in Examples of the present invention (Examples 1 and 2) wherein $F_{tc}/F_{tp}$ is at least 2.5, the number of contamination particles was small, and a glass plate having a conductive wiring of high image quality, was obtained.

According to the present invention, it is possible to form a conductive wiring of a high image quality with little contamination on a glass plate surface with good adhesion. Accordingly, the present invention is useful particularly for the production of a glass plate with conductive wirings (such as defogger wirings and antenna wirings) for automobile windows.

The entire disclosure of Japanese Patent Application No. 2006-002438 filed on Jan. 10, 2006 including specification, claims, drawings and summary are incorporated herein by reference in its entirety.

What is claimed is:

1. A developer for electronic printing, wherein the ratio of $F_{tc}/F_{tp}$ is at least 2.5, where $F_{tc}$ is the adhesive force acting between one toner particle comprising a maleic acid- or maleic anhydride-modified thermoplastic resin as a heat decomposable binder resin and conductive fine particles, and one carrier, and $F_{tp}$ is the adhesive force acting between one toner particle comprising said resin and conductive fine particles, and a photoconductor.

2. The developer for electronic printing according to claim 1, wherein $F_{tp}$ is at most 40 nN.

3. The developer for electronic printing according to claim 2, wherein $F_{tp}$ is at most 35 nN.

4. The developer for electronic printing according to claim 1, wherein the adhesive force $F_{tt}$ acting between one toner particle comprising conductive fine particles and another toner particle comprising conductive fine particles, is at most 30 nN.

5. The developer for electronic printing according to claim 4, wherein $F_{tt}$ is at most 27 nN.

6. The developer for electronic printing according to claim 1, wherein the toner particles have an average particle diameter of from 10 to 35 μm.

7. The developer for electronic printing according to claim 1, wherein the toner particles comprise said conductive fine particles, said heat decomposable binder resin and glass frit.

8. The developer for electronic printing according to claim 7, wherein the toner particles comprise, based on 100 parts by mass of the total solid content of the toner particles, from 59.8 to 83.8 parts by mass of the conductive fine particles, from 5 to 40 parts by mass of the heat decomposable binder resin and from 0.2 to 5 parts by mass of the glass frit.

9. The developer for electronic printing according to claim 7, wherein $T_{100}-T_{90}$ of the heat decomposable binder resin is from 0.1 to 15° C., wherein $T_{100}$ is a temperature at the time when a weight change of the resin has become no longer observed during a temperature rise from room temperature at a rate of 10° C./min by means of a thermogravimetric analyzer (TG), and $T_{90}$ is a temperature at the time when weight reduction of the resin has become 90 wt % during a temperature rise from room temperature at a rate of 10° C./min by means of a thermogravimetric analyzer.

10. The developer for electronic printing according to claim 7, wherein the maleic acid- or maleic anhydride-modified thermoplastic resin has an acid value of at least 5.

11. The developer for electronic printing according to claim 10, wherein the acid value is from 20 to 100.

12. A process for producing a glass plate having an electric conductor pattern, which comprises using a toner in the developer for electronic printing as defined in claim 1 and forming a pattern of the toner on a surface of a glass plate by an electronic printing system, and heating the glass plate having the pattern of the toner formed on its surface, at a predetermined temperature to convert the pattern of the toner to a pattern of an electric conductor.

13. The process according to claim 12, wherein the glass plate is an automobile window.

14. The process for producing a glass plate having an electric conductor pattern according to claim 12, wherein the temperature for heating the glass plate is from 600 to 740° C.

15. The process for producing a glass plate having an electric conductor pattern according to claim 12, wherein at the same time as the glass plate is heated to convert the pattern of the toner to a pattern of an electric conductor, the heated glass plate is subjected to thermal processing.

16. The developer for electronic printing according to claim 1, wherein $F_{tc}$ is at most 143 nN.

17. The developer for electronic printing according to claim 1, wherein $F_{tc}/F_{tp}$ is at least 3.0.

18. The developer for electronic printing according to claim 1, wherein the toner and the carrier are present in a weight ratio of 2-15 parts toner to 100 parts carrier.

19. The developer for electronic printing according to claim 1, wherein the maleic acid- or maleic anhydride-modified thermoplastic resin is maleic anhydride-modified polypropylene.

20. The developer for electronic printing according to claim 1, which is capable of developing an electronically printed pattern on a glass plate.

* * * * *